US012747065B2

(12) United States Patent
Marquit

(10) Patent No.: US 12,747,065 B2
(45) Date of Patent: Sep. 29, 2026

(54) STACKABLE CONTAINER SYSTEM FOR STORING AND REHEATING FOOD SLICE

(71) Applicant: Pie-Pod, LLC, Davie, FL (US)

(72) Inventor: Seth Marquit, Davie, FL (US)

(73) Assignee: Pie-Pod, LLC, Davie, FL (US)

( * ) Notice: Subject to any disclaimer, the term of this patent is extended or adjusted under 35 U.S.C. 154(b) by 268 days.

(21) Appl. No.: 18/251,892

(22) PCT Filed: Nov. 5, 2021

(86) PCT No.: PCT/US2021/058163

§ 371 (c)(1),
(2) Date: May 5, 2023

(87) PCT Pub. No.: WO2022/098937

PCT Pub. Date: May 12, 2022

(65) Prior Publication Data

US 2024/0059455 A1 Feb. 22, 2024

Related U.S. Application Data

(60) Provisional application No. 63/110,507, filed on Nov. 6, 2020.

(51) Int. Cl.
*B65D 21/08* (2006.01)
*B65D 81/34* (2006.01)

(52) U.S. Cl.
CPC ..... *B65D 21/083* (2013.01); *B65D 81/343* (2013.01); *B65D 81/3453* (2013.01); *B65D 2581/3406* (2013.01)

(58) Field of Classification Search
CPC ..... B65D 41/22; B65D 81/343
See application file for complete search history.

(56) References Cited

U.S. PATENT DOCUMENTS

| | | | | |
|---|---|---|---|---|
| 4,313,542 | A | 2/1982 | Roberts et al. | |
| 7,594,586 | B2 * | 9/2009 | Cai | B65D 81/2038 220/366.1 |
| 8,381,909 | B2 | 2/2013 | Hernandez et al. | |
| 9,988,204 | B1 | 6/2018 | Levneff et al. | |
| 2014/0262920 | A1 | 9/2014 | Andrews et al. | |

OTHER PUBLICATIONS

Kim, Harry, "International Search Report and Written Opinion Issued in International Application No. PCT/US2022/058163", Jan. 31, 2022, p. 14, Published in: US.
PCT, "International Preliminary Report on Patentability Regarding PCT/US2021/058163", May 19, 2023, p. 8, Published in: CH.

* cited by examiner

*Primary Examiner* — Jeffrey R Allen
(74) *Attorney, Agent, or Firm* — NOD Law PC

(57) ABSTRACT

This disclosure describes systems, methods, and apparatus for stackable food storage and reheating. The stackable food container can be three-sided, and/or triangular, and can include a lid with a viewing window, a thermally conductive tray, and optionally one or more stacking inserts therebetween. The thermally conductive tray can be configured to absorb large amounts of thermal energy during a pre-heating stage, and to then efficiently transfer much of that energy to a bottom or crust of the food item during a re-heating stage thereby enabling a Maillard effect not possible with existing food containers.

17 Claims, 28 Drawing Sheets

STACKABLE CONTAINER SYSTEM FOR STORING AND REHEATING FOOD SLICE

CLAIM OF PRIORITY UNDER 35 U.S.C. § 119

The present application is a national phase application based on PCT/US2021/058163 filed Nov. 5, 2021 entitled "STACKABLE CONTAINER SYSTEM FOR STORING AND REHEATING FOOD SLICE" which claims priority to Provisional Application No. 63/110,507 entitled "A device for storing, stacking, preserving, transporting, reheating, crisping, and visualizing, a single slice of pie, for example but not limited to pizza" filed Nov. 6, 2020, and assigned to the assignee hereof and hereby expressly incorporated by reference herein.

FIELD OF THE DISCLOSURE

The present disclosure relates generally to food storage and reheating. In particular, but not by way of limitation, the present disclosure relates to systems, methods and apparatuses for stackable food containers that can also be used for reheating.

DESCRIPTION OF RELATED ART

Containers for storing a single slice of pie, pizza, or other triangular flat food are not common, and among those known, such containers tend to be difficult to transport, provide poor visibility to the contained food, and are not adapted for reheating. Where such containers can be used to reheat in an oven or microwave, the bottom or crust of the food tends to be soggy or remain/become soft and chewy after reheating. For instance, U.S. Design Pat. No. 507,453 provides a triangular food storage container that provides air channels below a bottom surface of the stored food. Where such a design is used in reheating, the small surface area under the food leads to poor thermal transmission to the food. Similarly, U.S. Design Pat. No. 391,808 also provides a triangular storage container, but instead of channels, this design uses raised knobs to allow air flow below the food, again reducing thermal conductivity to a bottom of the food during reheating. U.S. Pat. No. 9,814,330 provides a triangular food storage container, but there is no consideration for reheating and crisping of a bottom or crust of the food. Further, in all of these designs, the food storage volume is fixed by a height of the container.

SUMMARY OF THE DISCLOSURE

The following presents a simplified summary relating to one or more aspects and/or embodiments disclosed herein. As such, the following summary should not be considered an extensive overview relating to all contemplated aspects and/or embodiments, nor should the following summary be regarded to identify key or critical elements relating to all contemplated aspects and/or embodiments or to delineate the scope associated with any particular aspect and/or embodiment. Accordingly, the following summary has the sole purpose to present certain concepts relating to one or more aspects and/or embodiments relating to the mechanisms disclosed herein in a simplified form to precede the detailed description presented below.

This disclosure improves upon existing food containers by providing a stackable food container system (triangular or three-sided in shape) that can go into a microwave, oven, or other heating machine, and provide a crisp bottom or crust after reheating. The system can have a triangular, rectangular, or square shape depending on the intended food shape and type to be stored (e.g., can be three- or four-sided). The thermally conductive crisping tray can be configured to absorb large amounts of thermal energy during a pre-heating stage, and to then efficiently transfer much of that energy to a bottom or crust of the food item during a re-heating stage thereby enabling a Maillard effect not possible with existing food containers. The lid can include a transparent viewing window made from a flexible film such as a flexible and elastic polymer film, that both allows better visibility into the container and enhances food preservation. Preservation is enhanced by reducing the air volume around the food and thus oxidation thereof. This disclosure can be applied to any three-sided food, such as, but not limited to pie slices and pizza slices.

Some embodiments of the disclosure may be characterized as a stackable triangular food container system including a triangular lid, a first triangular stackable insert, and a triangular thermally conductive tray. The triangular lid can have three polymer sides and a transparent elastic polymer film stretched across an opening in a top of the triangular lid to provide visibility into the stackable triangular food container system. The first triangular stackable insert can be selectively arranged between the triangular lid and a triangular thermally conductive tray and can have a floor arranged between sides of the first triangular stackable insert. The triangular thermally conductive tray can be configured to be pre-heated without a food item and then heated in an oven or microwave with the food item resting thereupon to effect Maillard transformation of a bottom surface of the food item when reheated upon the triangular thermally conductive tray.

Other embodiments of the disclosure may also be characterized as three- or four-sided stackable food container system. The system can include a three- or four-sided lid, a three- or four-sided thermally conductive tray, and a first three- or four-sided stackable insert. The three- or four-sided lid can have a transparent elastic film stretched across an opening in a top thereof, and a retaining channel in a bottom of the three- or four-sided lid. The three- or four-sided thermally conductive tray can have a circumferential lip extending up from the three- or four-sided thermally conductive tray and configured for first selective engagement with the retaining channel in the three- or four-sided lid. The first three- or four-sided stackable insert is configured for second selective engagement with the retaining channel in the three- or four-sided lid and configured for third selective engagement with the circumferential lip in the three- or four-sided thermally conductive tray. The three- or four-sided lid and the first three- or four-sided stackable insert, when coupled, form a first sealed volume sized to accept a first substantially flat food item. The first three- or four-sided stackable insert and a second three- or four-sided stackable insert, when coupled, form a second sealed volume sized to accept a second substantially flat food item. The first three- or four-sided stackable insert or the second three- or four-sided stackable insert, and the three- or four-sided thermally conductive tray, when coupled, form a third sealed volume sized to accept a third substantially flat food item Other embodiments of the disclosure can be characterized as a method of storing and reheating a triangular food item. The method can include providing a triangular container comprising: a lid with a transparent viewing window; and a metal alloy tray with an upper lip that selectively slots into a retaining channel in a bottom of the lid, or in a stackable insert, to form a nearly-air-tight seal between the lid, or the stackable insert, and the metal alloy tray; placing the triangular food item into the triangular container and refrigerating the triangular container. The method can also include pre-heating the metal alloy tray in a heating machine without the triangular food item. The method can also include placing the triangular food item onto the metal alloy tray. The method can also include leaving the metal alloy tray in the heating machine with the triangular food item arranged thereon for a sufficient time to allow a bottom surface of the triangular food item to undergo a Maillard effect.

BRIEF DESCRIPTION OF THE DRAWINGS

Various objects and advantages and a more complete understanding of the present disclosure are apparent and more readily appreciated by referring to the following detailed description and to the appended claims when taken in conjunction with the accompanying drawings:

DETAILED DESCRIPTION

Figure 1:
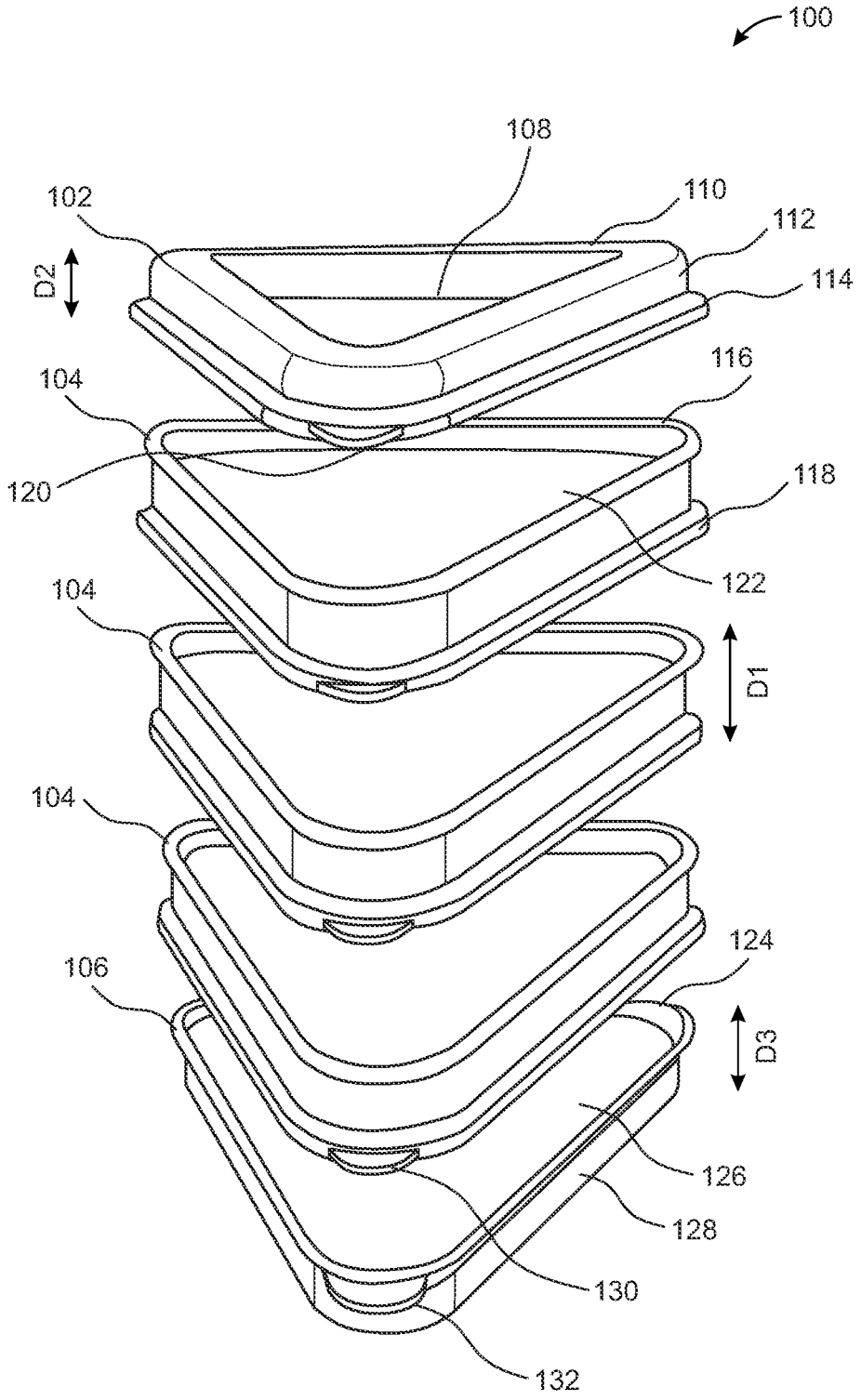
FIG. 1 illustrates an exploded view stackable triangular food container system including three stackable inserts between a lid and a thermally conductive tray.

The present disclosure relates generally to a food storage and reheating/crisping container system. More specifically, but without limitation, the present disclosure relates to a system of one or more stackable containers with a thermally conductive tray for reheating/crisping food slices and a transparent flexible viewing window in a lid.

The word "exemplary" is used herein to mean "serving as an example, instance, or illustration." Any embodiment described herein as "exemplary" is not necessarily to be construed as preferred or advantageous over other embodiments.

Preliminary note: the flowcharts and block diagrams in the following Figures illustrate the architecture, functionality, and operation of possible implementations of systems, methods according to various embodiments of the present disclosure. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer, or section. Thus, a first element, component, region, layer, or section discussed below could be termed a second element, component, region, layer, or section without departing from the teachings of the present disclosure.

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below. The device may be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items, and may be abbreviated as "/".

It will be understood that when an element or layer is referred to as being "on," "connected to," "coupled to," or "adjacent to" another element or layer, it can be directly on, connected, coupled, or adjacent to the other element or layer, or intervening elements or layers may be present. In contrast, when an element is referred to as being "directly on," "directly connected to," "directly coupled to," or "immediately adjacent to" another element or layer, there are no intervening elements or layers present.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing. Accordingly, the regions illustrated in the figures are schematic in nature and their shapes are not intended to illustrate the actual shape of a region of a device and are not intended to limit the scope of the disclosure.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

As stated above, there are very few options for storing single slices of three-sided foods such as pie and pizza. A slice of three-sided food is often saved in a cardboard box, a paper bag, or placed in plastic wrap or aluminum foil. These approaches provide poor preservation (e.g., high rates of oxidation) and are troublesome to transport and are not efficient users of space within refrigerators and other volumes of limited storage. Existing containers also provide poor reheating characteristics, being made of a material with a low melting point (e.g., many polymers cannot be reheated in an oven), or being thermally insulating, which leads to a soft or soggy crust or bottom upon reheating.

This disclosure provides systems, methods, and apparatus for stackable storage of a three-sided food item in a container that can be reheated in an oven, microwave, or other heating machine, that achieves more effective food preservation than the prior art, and that causes the bottom or crust to see a Maillard transformation (or crisping) during reheating. The container can include a lid and optionally one or more stacking inserts formed from polymers with a high enough melting temperature to be usable in an oven, microwave, or other common household/restaurant heating machine. A crisping tray can be arranged on a bottom of the stack and can be formed from a thermally conductive material (e.g., triangular or three-sided in shape), such as a metal alloy, such as, but not limited to an aluminized steel alloy. The tray can be coated to help prevent food from sticking to its surface, for instance, the tray can be silicone coated.

Figure 2:
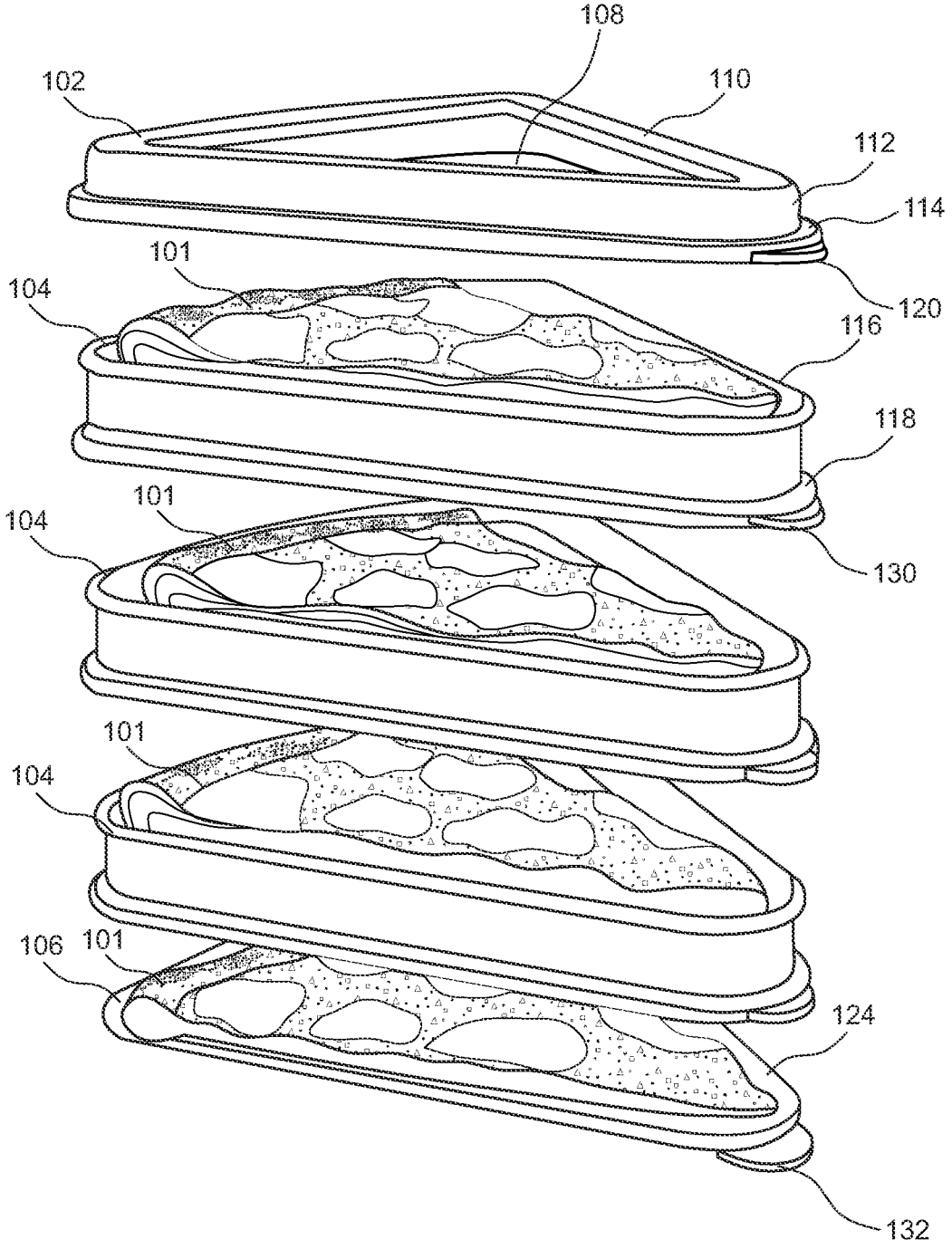
FIG. 2 illustrates another exploded view of the stackable triangular food container system including four slices of pizza.
Figure 3:
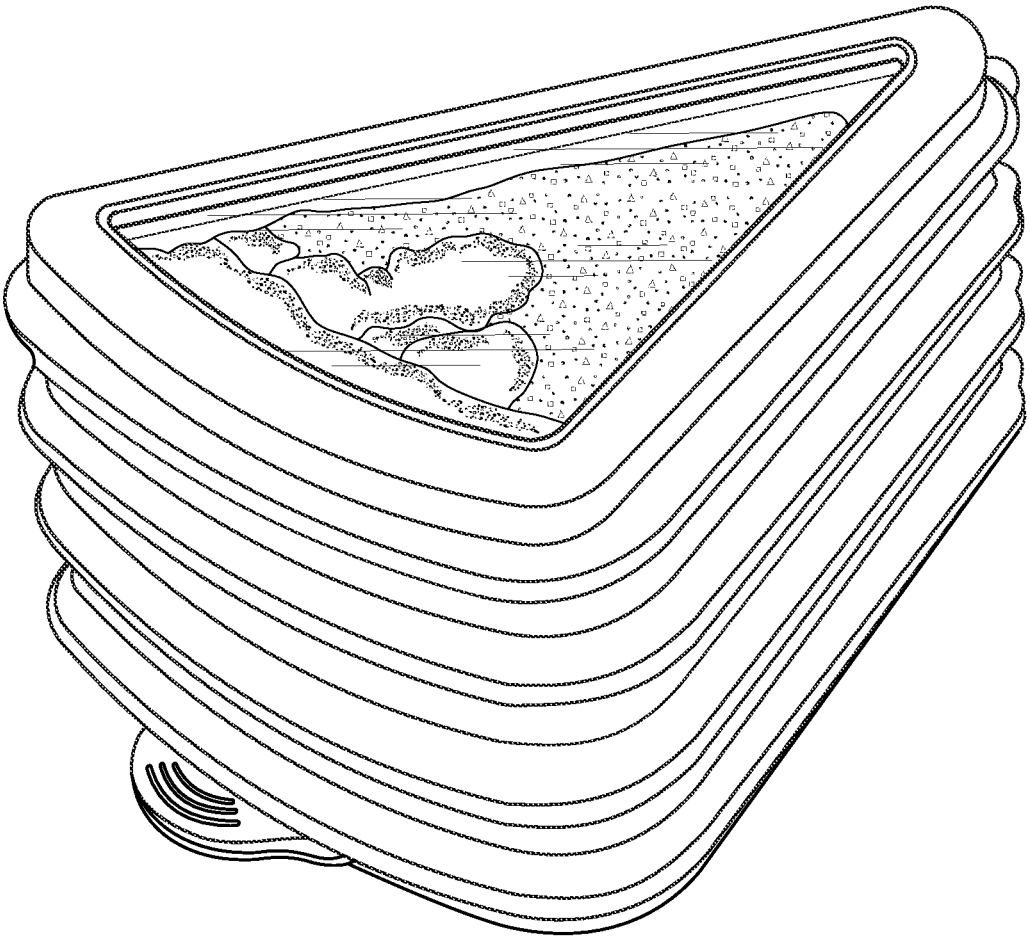
FIG. 3 illustrates the stackable triangular food container system with three stackable inserts in use.
Figure 4:
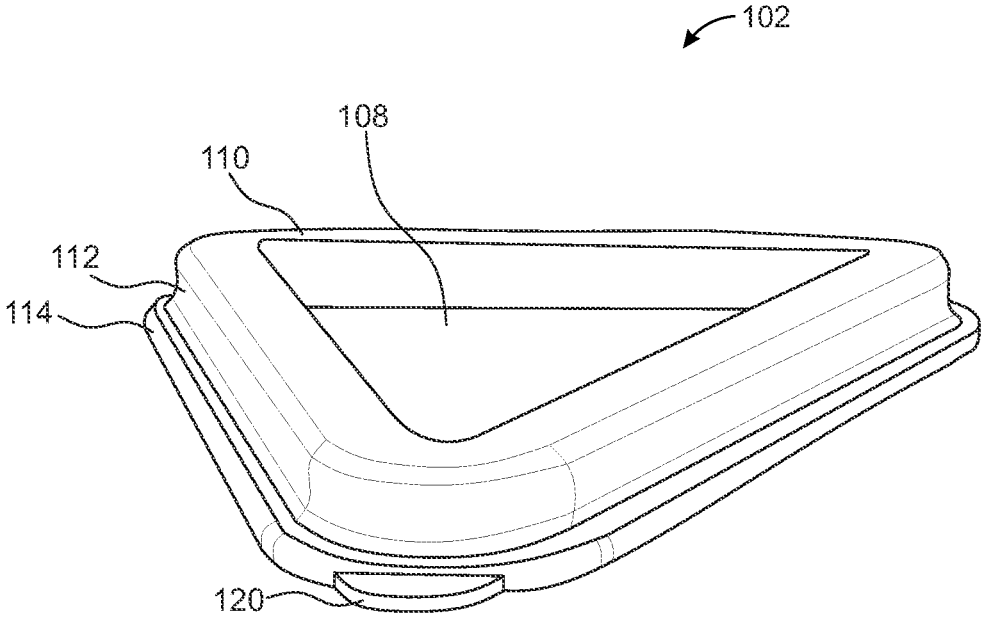
FIG. 4 illustrates an isometric view of the lid.
Figure 5:
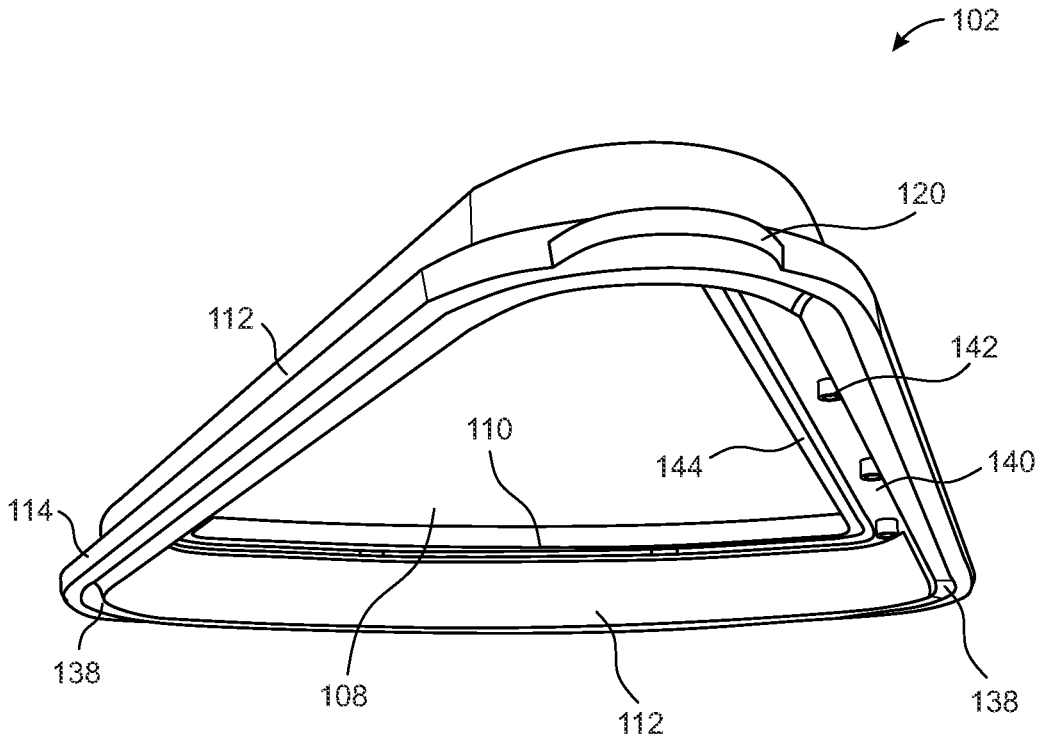
FIG. 5 illustrates another isometric view of the lid showing the bottom thereof.
Figure 6:
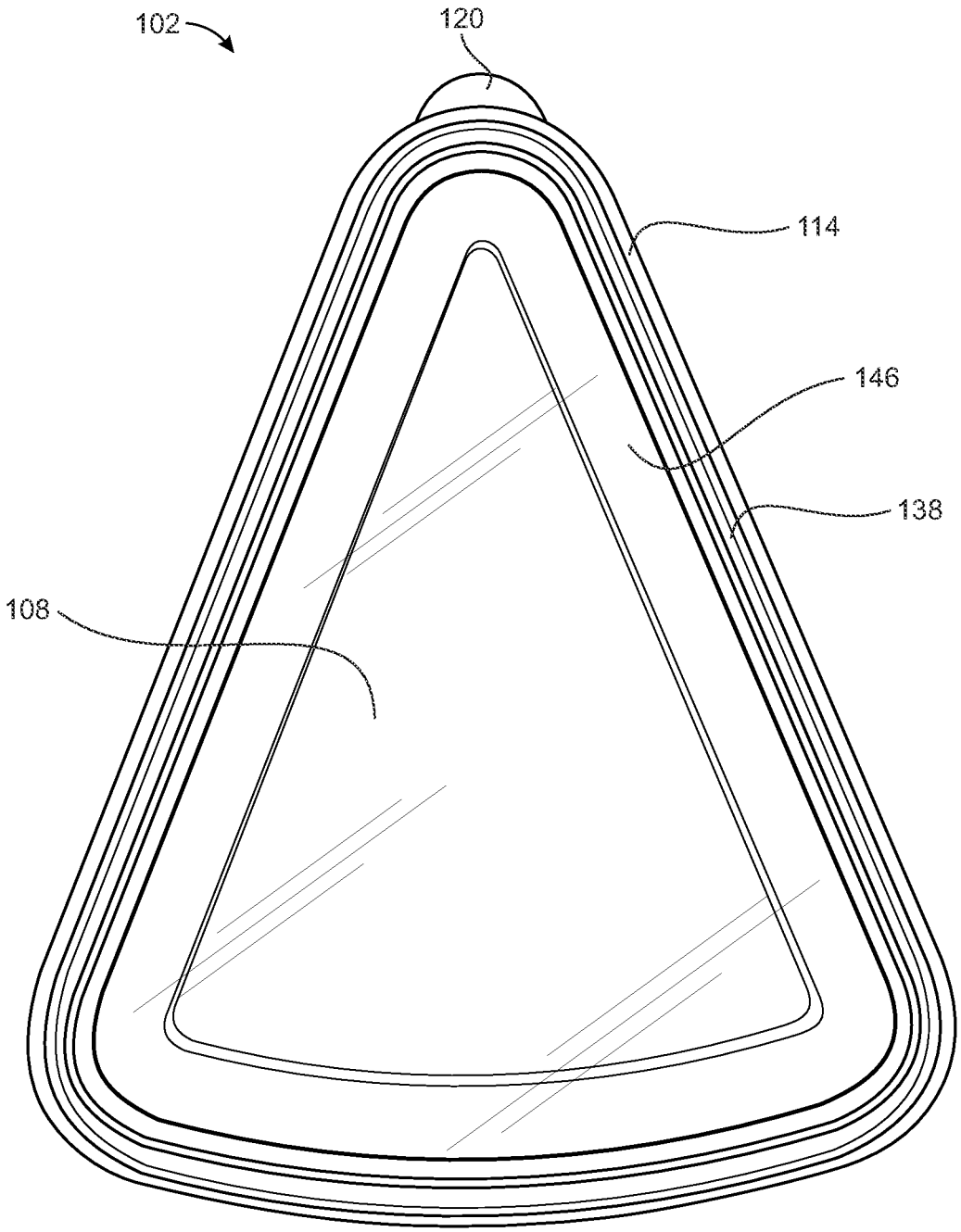
FIG. 6 illustrates a bottom view of the lid.
Figure 7:
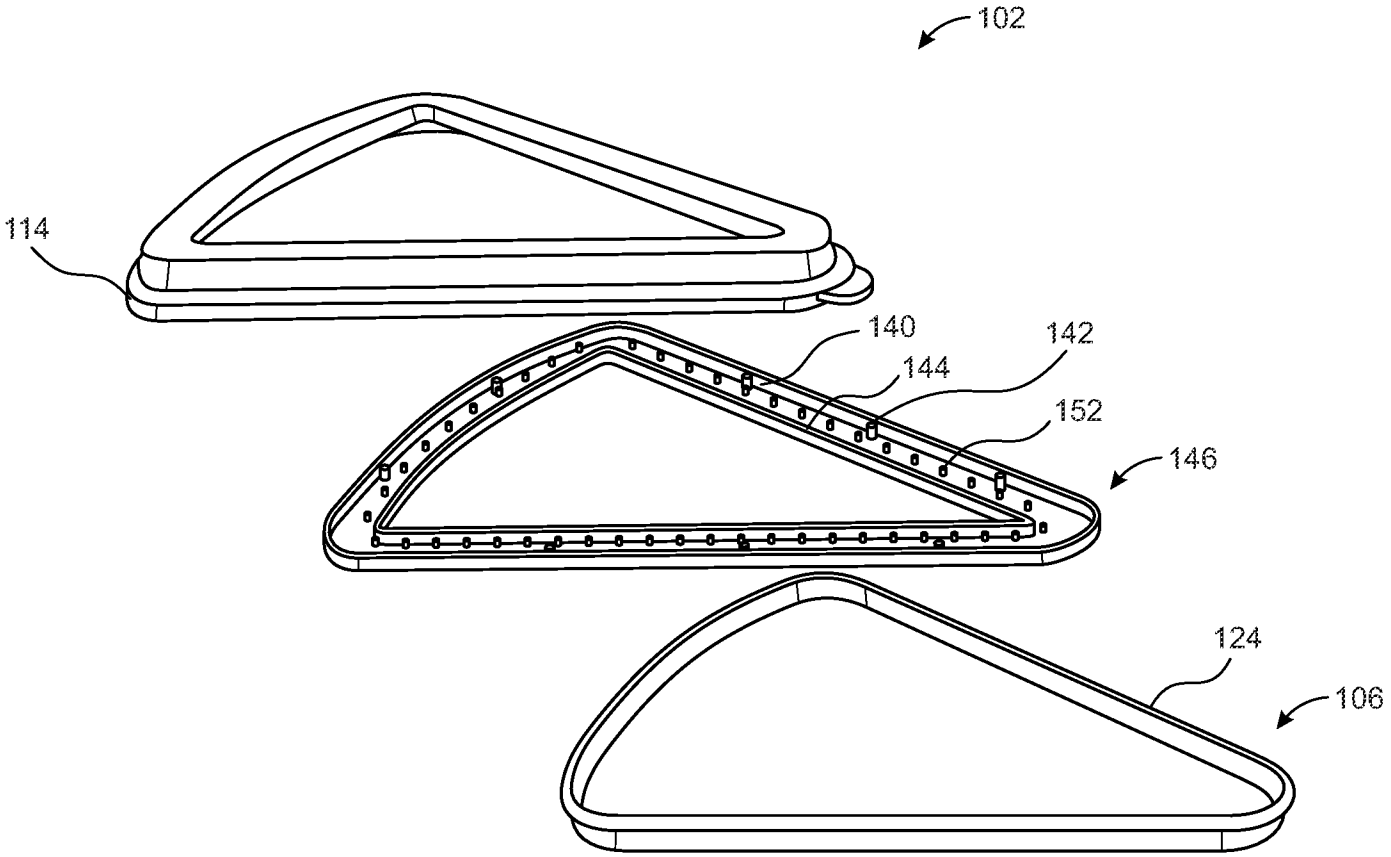
FIG. 7 illustrates an exploded view of the lid showing the frame.
Figure 8:
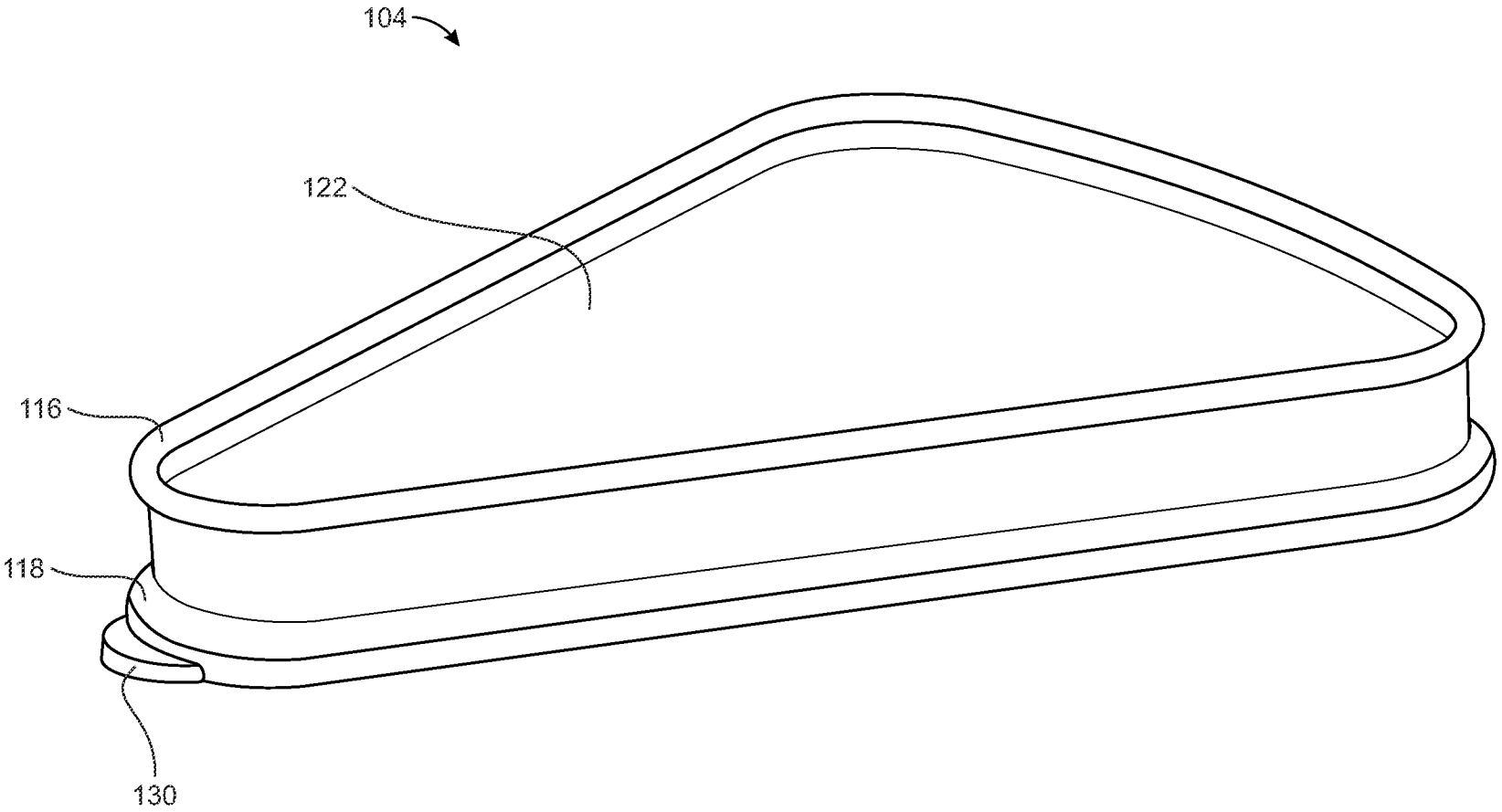
FIG. 8 illustrates an isometric view of one of the stackable inserts.
Figure 9:
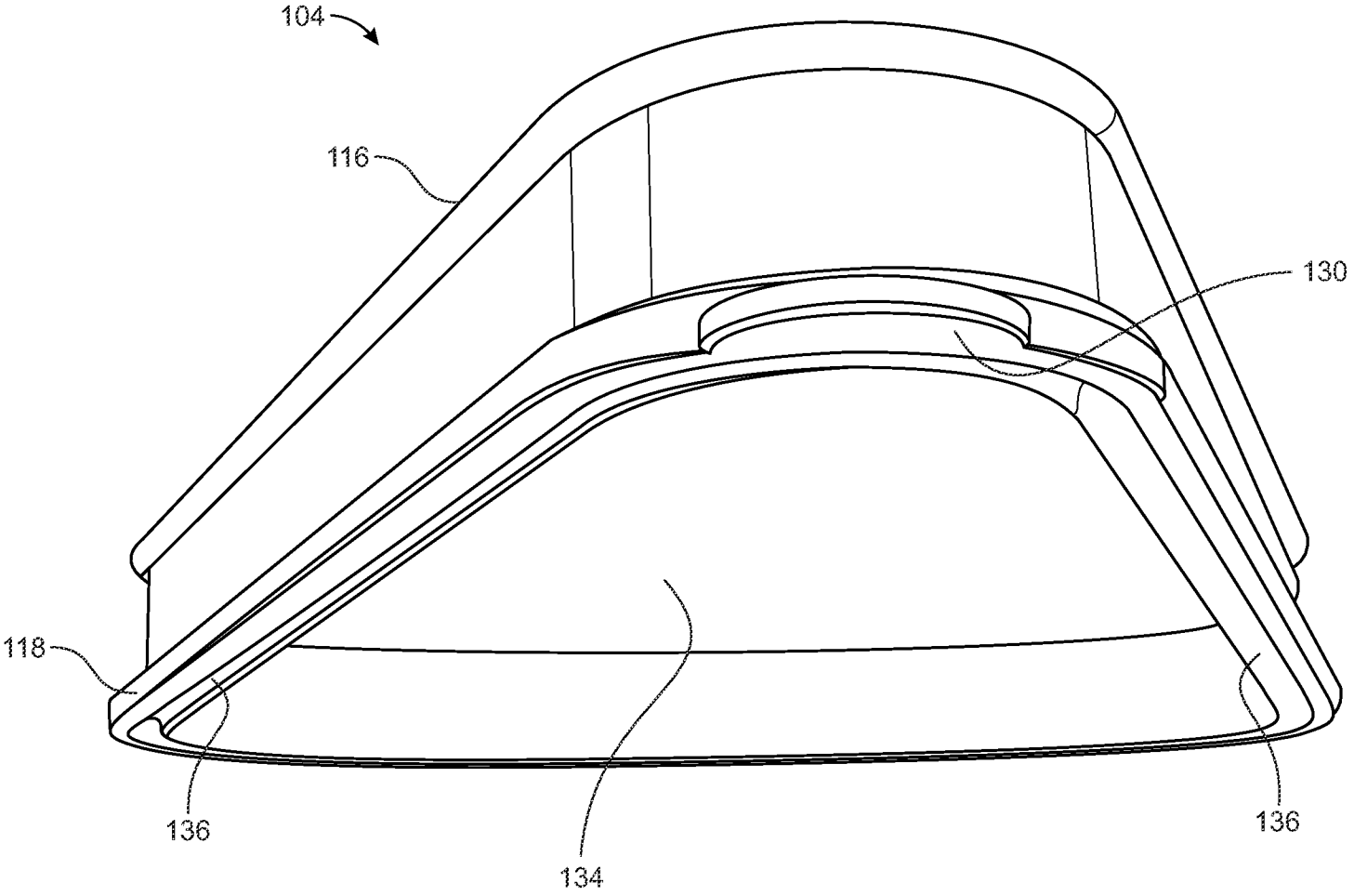
FIG. 9 illustrates another isometric view of the one of the stackable inserts showing a bottom thereof.
Figure 12:
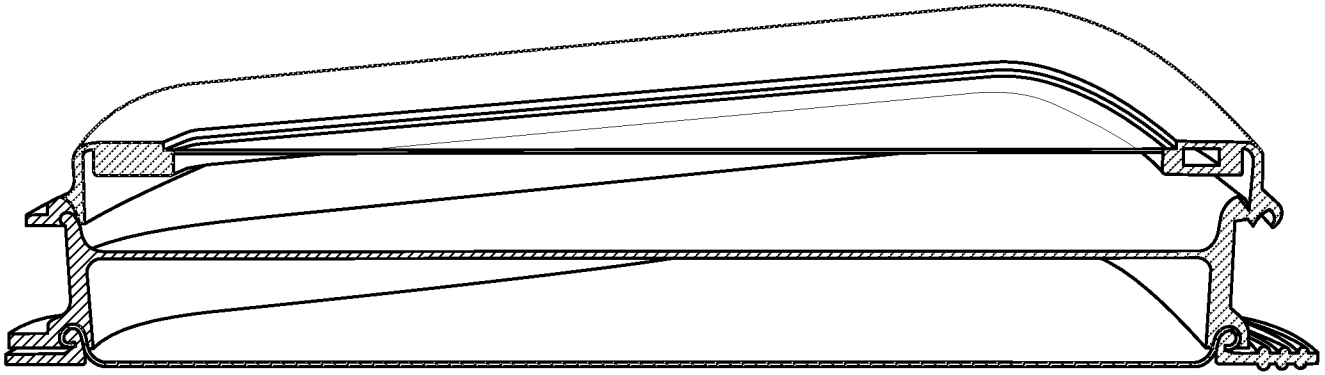
FIG. 12 illustrates a cross sectional view of a stackable triangular food container system with a single stackable insert.
Figure 13:
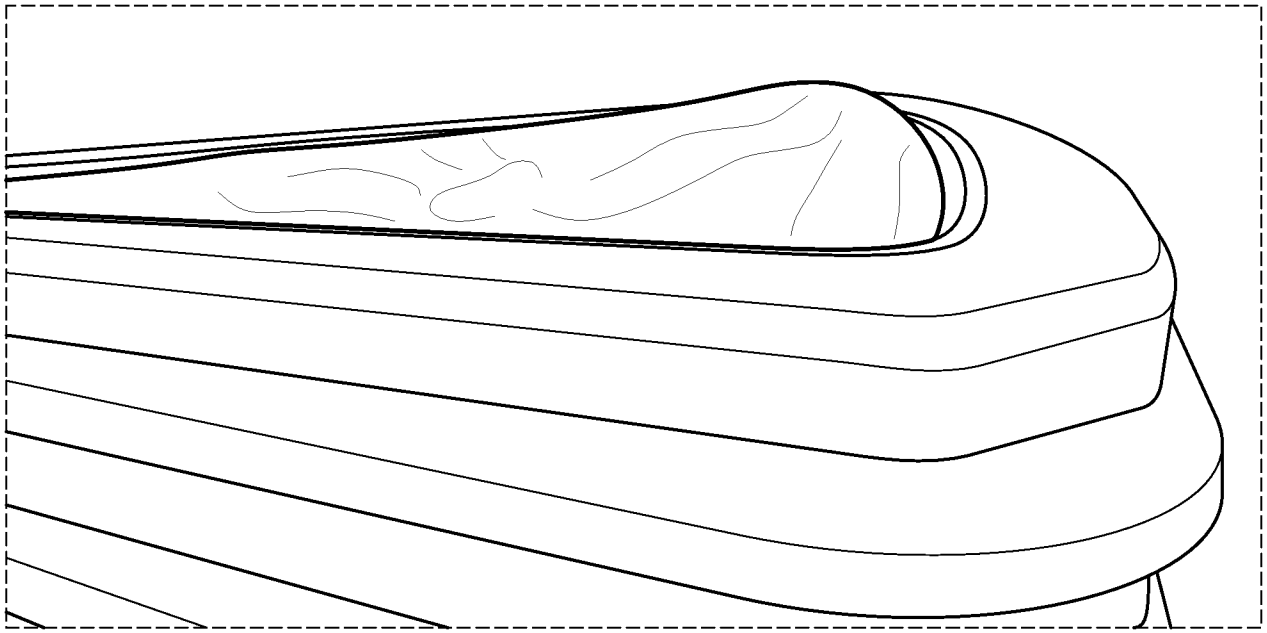
FIG. 13 illustrates stretching of the transparent elastic film used to minimize air volume within the container and accommodate foods that are larger than the volume in the container.
Figure 14:
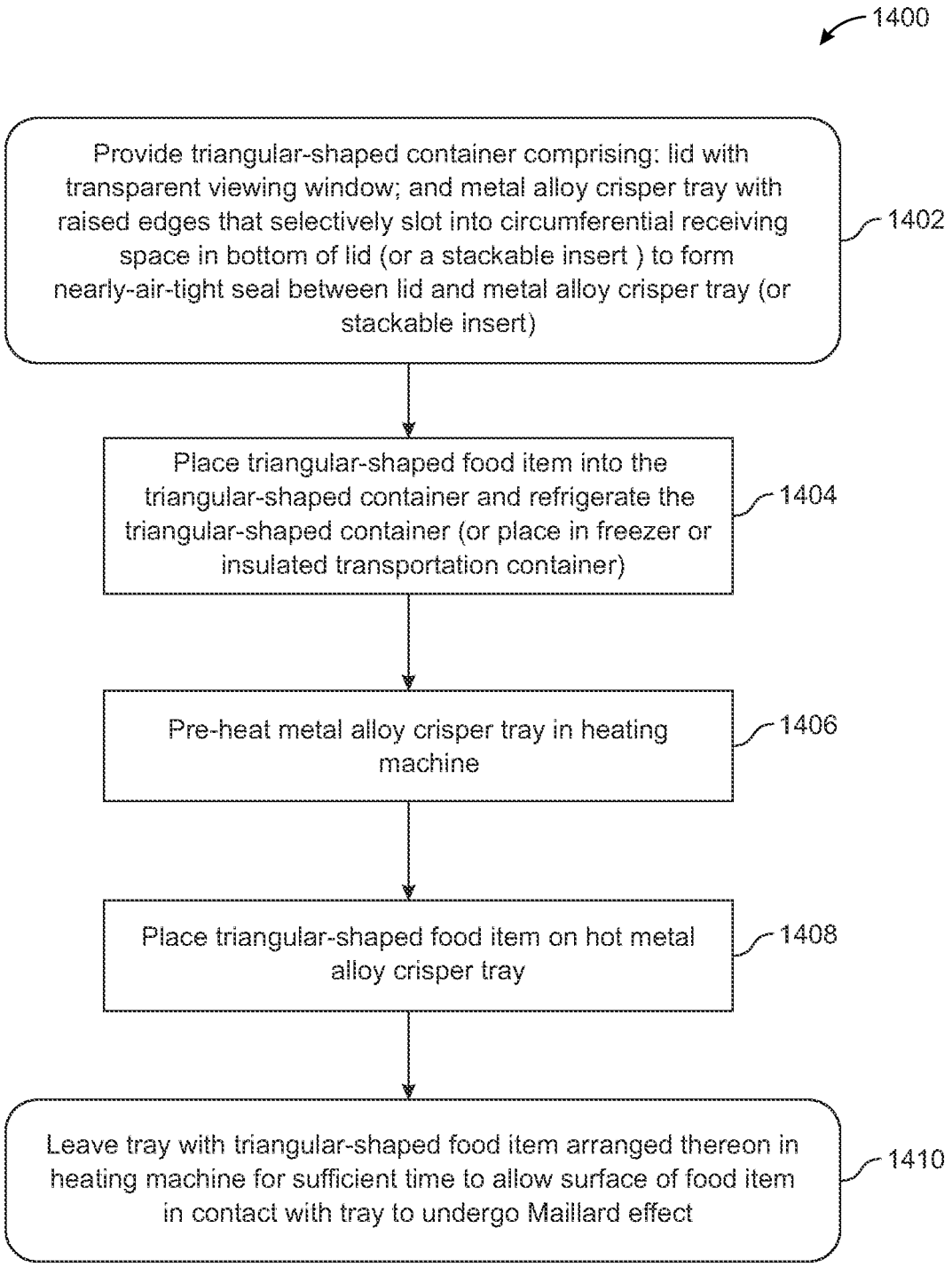
FIG. 14 illustrates a method of using a stackable triangular food container system.
Figure 15:
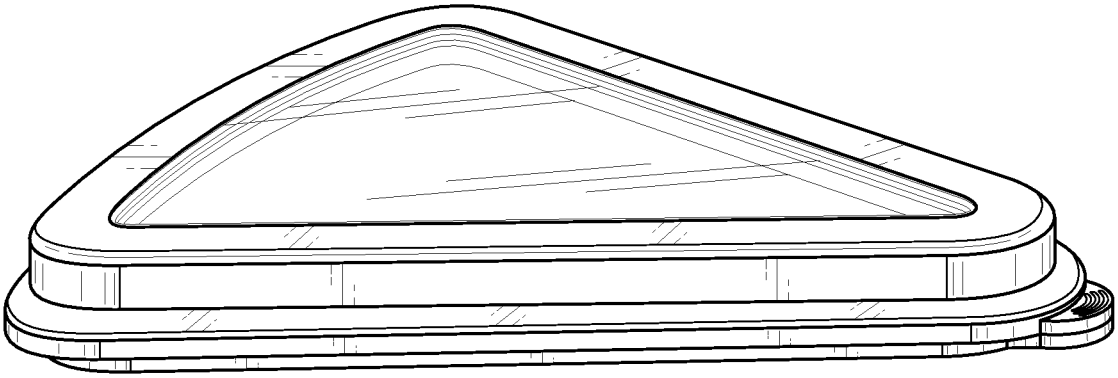
FIG. 15 illustrates a top left isometric view of an embodiment of a stackable triangular food container system.
Figure 16:
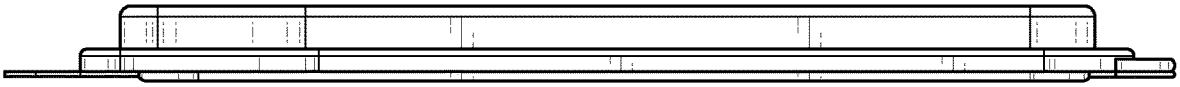
FIG. 16 illustrates a left elevation view of the stackable triangular food container system shown in FIG. 15.
Figure 17:
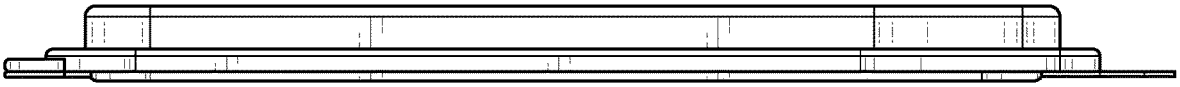
FIG. 17 illustrates a right elevation view of the stackable triangular food container system shown in FIG. 15.
Figure 18:
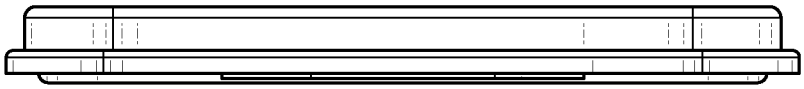
FIG. 18 illustrates a rear elevation view of the stackable triangular food container system shown in FIG. 15.
Figure 19:
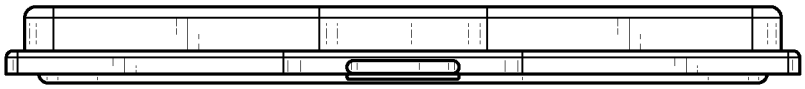
FIG. 19 illustrates a front elevation view of the stackable triangular food container system shown in FIG. 15.
Figure 20:
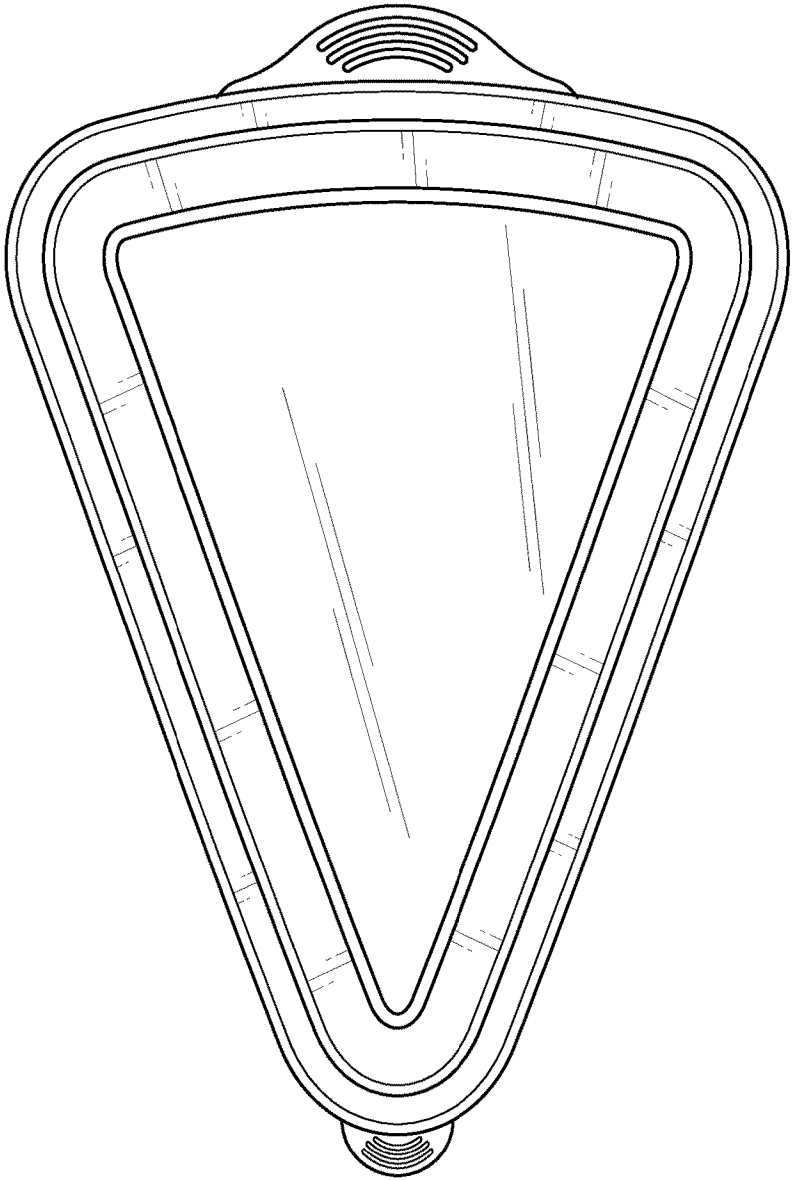
FIG. 20 illustrates a top view of the stackable triangular food container system shown in FIG. 15.
Figure 21:
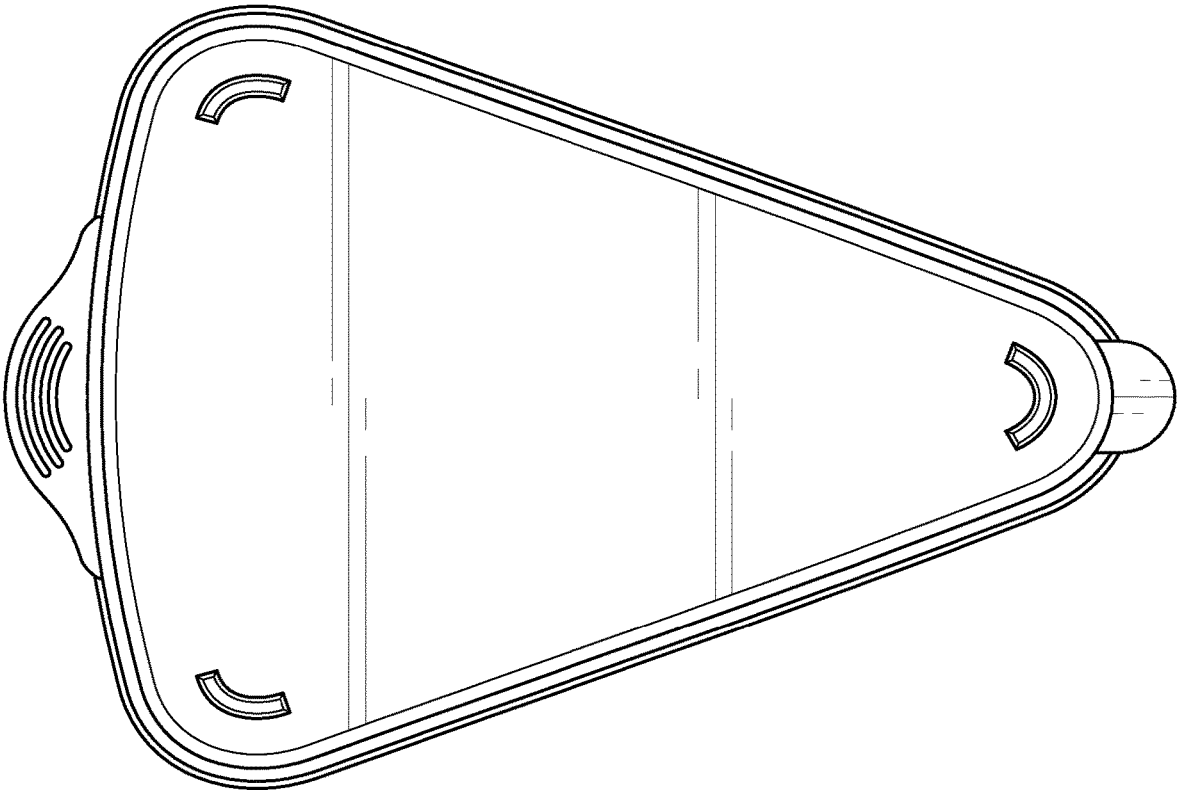
FIG. 21 illustrates a bottom view of the stackable triangular food container system shown in FIG. 15.
Figure 22:
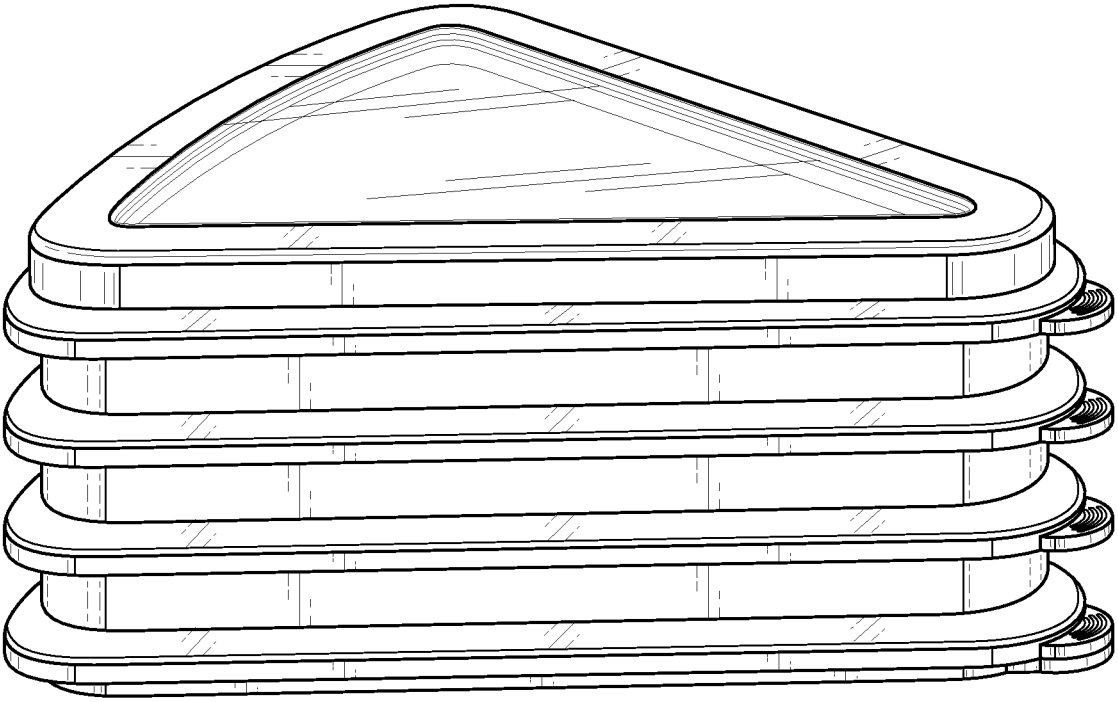
FIG. 22 illustrates a top left isometric view of another embodiment of a stackable triangular food container system.
Figure 23:
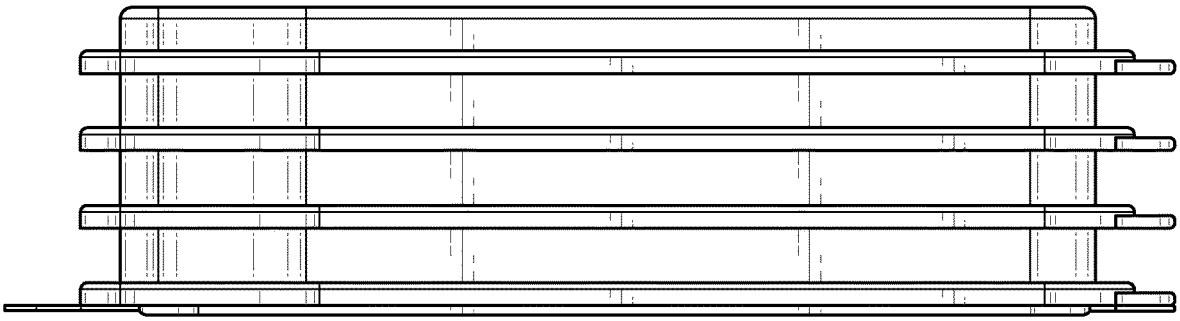
FIG. 23 illustrates a left elevation view of the stackable triangular food container system shown in FIG. 22.
Figure 24:
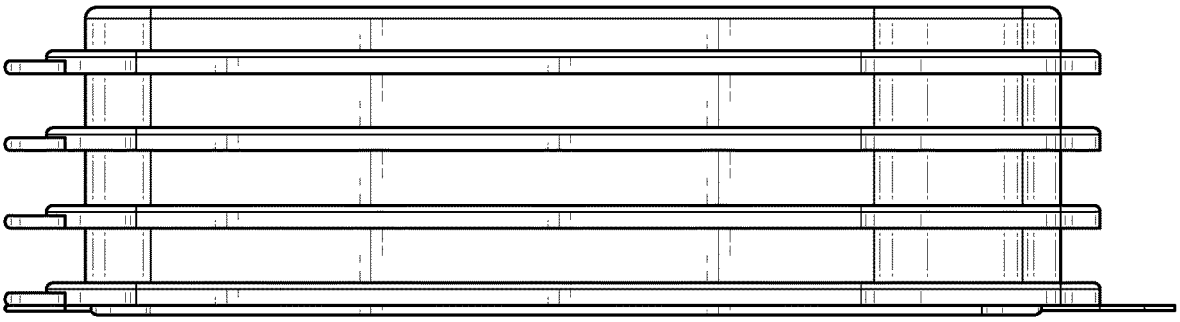
FIG. 24 illustrates a right elevation view of the stackable triangular food container system shown in FIG. 22.
Figure 25:
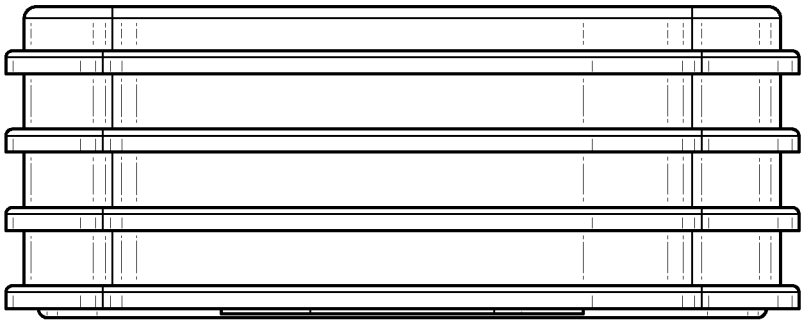
FIG. 25 illustrates a rear elevation view of the stackable triangular food container system shown in FIG. 22.
Figure 26:
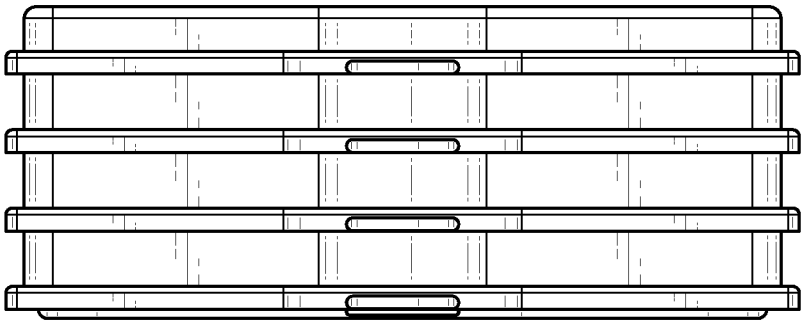
FIG. 26 illustrates a front elevation view of the stackable triangular food container system shown in FIG. 22.
Figure 27:
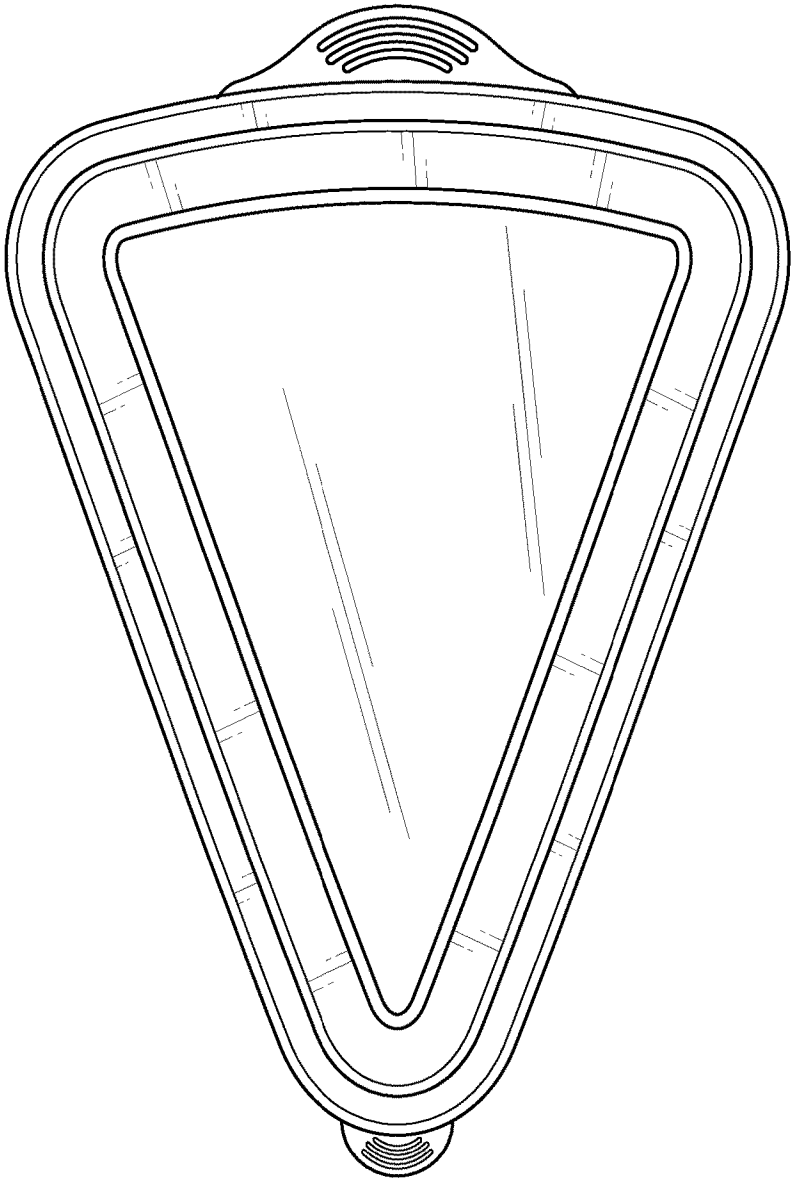
FIG. 27 illustrates a top view of the stackable triangular food container system shown in FIG. 22.
Figure 28:
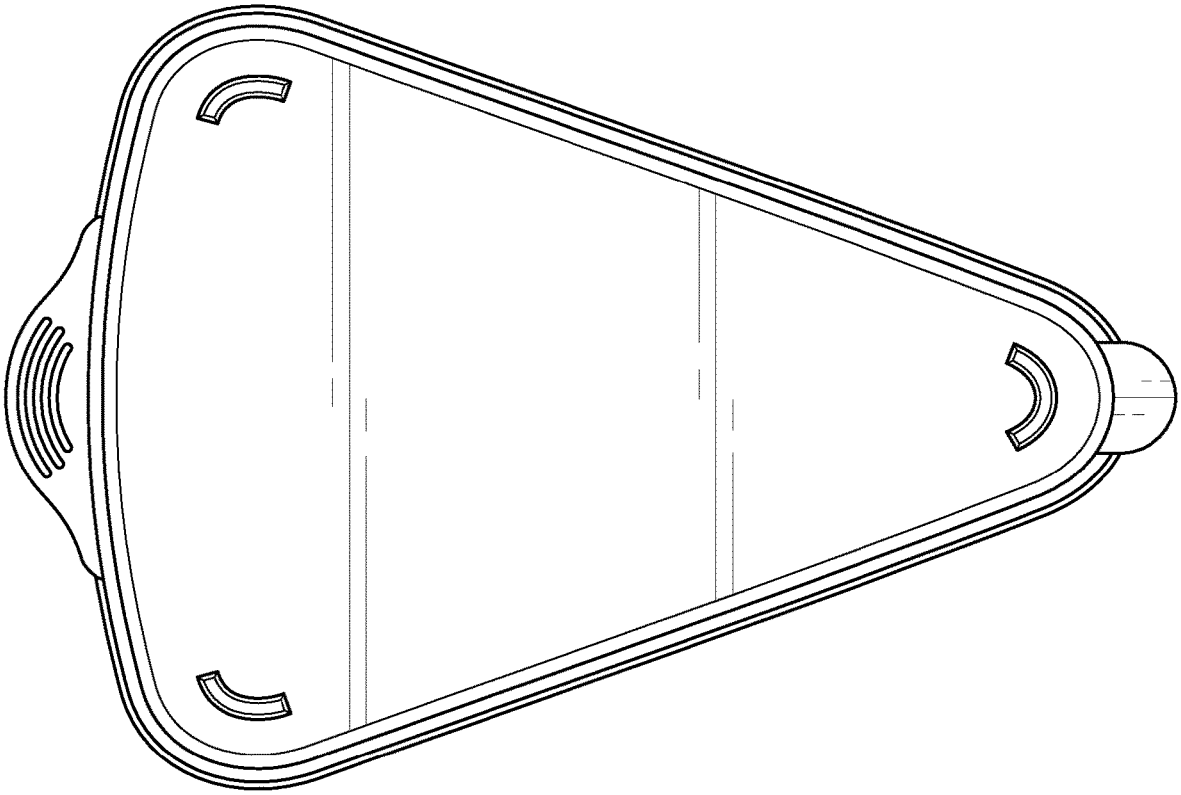
FIG. 28 illustrates a bottom view of the stackable triangular food container system shown in FIG. 22.

FIGS. 1-3 provide an overview of the stackable triangular food container system comprising a lid, optionally one or more stackable inserts, and a thermally conducting tray. FIGS. 4-6 present details of the lid, FIG. 7 shows details of a frame that holds a transparent elastic polymer film to the inside of the lid, FIGS. 8-9 show details of a stackable insert, and FIG. 10 shows details of the thermally conducting tray. FIGS. 11-12 show cross sections of the stackable food container, and FIG. 13 shows stretching of the transparent elastic polymer film in the lid, which helps to reduce oxidation of foods stored in the container and accommodate foods that are larger than the volume in the container. FIG. 14 provides a method of using the stackable food container.

The stackable triangular food container system 100 seen in FIG. 1 comprises a triangular lid 102 and a thermally conductive tray 106 (or "tray") for storing and reheating a single slice of pie, pizza, or other three-sided food. The tray 106 can be formed from a metal alloy and can thus also be referred to in certain embodiments, as a metal alloy crisping tray 106. The system 100 can also include one or more optional stackable inserts 104, where FIG. 1 shows an embodiment, where three stackable inserts 104 are used. The lid 102 is triangular, or three-sided, and can be formed from a polymer that can withstand high temperatures, such as those seen in an oven (though typically the lid 102 is not used in an oven). At the same time, the polymer is one that can be microwaved and washed in a dishwasher without significant degradation or deformation. The lid 102 further includes a transparent elastic polymer film stretched across an opening 108 in a top of the lid 102 to provide visibility into the stackable triangular food container system 100 and more specifically into a first volume formed by the lid 102 and a top-most of the three stackable inserts 104 (which may be referred to as a first stackable insert 104). In other words, the lid 102 and the first stackable insert 104, when coupled, form a first sealed volume sized to accept a first substantially flat food item 101. The lid 102 further includes three sides 112 that are substantially vertical, and a lower lip 114 with a retaining channel (see retaining channel 138 in FIG. 5) in an underside thereof for receiving an upper circumferential lip 116 of the stackable insert 104 below the lid 102. In other words, the upper circumferential lip 116 of the stackable insert 104 is configured for selective engagement with the retaining channel in the lower lip 114. The lower lip 114 protrudes outward from substantially vertical planes formed by the sides 112, and this greater width allows space for the lid channel seen in FIG. 5.

It should be noted that although this disclosure discusses and shows an elastic polymer film, in other embodiments, a fixed or rigid material could be used and it can be transparent, opaque, or semi-transparent.

Each of the optional stackable inserts 104 is selectively arranged between (1) the lid 102 and the tray 106, (2) the lid 102 and another stackable insert 104, (3) two stackable inserts 104, or (4) a stackable insert 104 and the tray 106. By selectively, it is meant that the lid 102, optionally the stackable inserts 104, and the tray 106 can be pressed together to form airtight volumes for storing food, and can be removed merely by locking and unlocking of friction fit interfaces or snap lock interfaces formed by lips and channels of these various components. Each optional stackable insert 104 can include a floor 122 arranged between the sides and arranged partway between a top and bottom of the stackable insert 104. In some case, the floor 122 can be arranged more toward a top of each insert 104, and in others the floor 122 can be arranged more toward a bottom of each insert 104, and in this way a designer can tailor a size of each storage volume. Each stackable insert 104 can include an upper circumferential lip 116 for interfacing with the lower lip 114 of the lid 102 or with a lower lip 118 of another stackable insert 104. As seen in FIG. 9, like the lid 102, each stackable insert 104 includes a retaining channel 136 in a bottom of the lower lip 118. This retaining channel is configured for selective engagement with an upper circumferential lip 116 of another stackable insert 104 or an upper circumferential lip 124 of the tray 106. In one embodiment, the first stackable insert 104 and a second three-sided stackable insert 104, when coupled, form a second sealed volume sized to accept a second substantially flat food item. When one stackable insert 104 is used, the first stackable insert 104 and the thermally conductive tray 106 (triangular or three-sided in shape), when coupled, form a second sealed volume sized to accept a second substantially flat food item 101. Where multiple stackable inserts 104 are used, the second stackable insert 104 and the thermally conductive tray 106, when coupled, form a third sealed volume sized to accept a third substantially flat food item 101.

The tray 106 includes an upper circumferential lip 124, that may be angled outward from a center of the tray 106, although this upper circumferential lip 124 may also be arranged substantially vertically in an alternative. In some embodiments, the tray 106 can include a hollow base 128 to help lift the tray 106 off a bottom of a heating machine such as an oven or microwave. Alternatively, and as shown in FIGS. 12 and 13B a bottom of the tray 106 can include an insulating base, for instance, made from silicone, instead of the hollow base 128.

Each of the lid 102, any optional stackable inserts 104, and the tray 106, can include one, two, or more thermally insulating tabs 120, 130, 132 to make it easier to remove one of these from an underlying component. The thermally insulating tab 132 on the tray 106 may be formed from a polymer, such as silicone, thereby giving a user a non-metallic (and thus cooler) location on the tray 106 to access the tray after pre-heating and reheating.

FIG. 2 illustrates the stackable triangular food container system 100 seen in FIG. 1, but with a three-sided and substantially flat food item 101 (e.g., pizza) arranged on the floor 122 of each of three stackable inserts 104 and one food item 101 on the floor 126 of the tray 106. A height of each component in the stack is much less than a width thereof in order to accommodate substantially flat food items while minimizing a volume of air in each compartment in the stack. In particular, the optional stackable inserts 104 can have a first height D1, the lid 102 can have a second height D2, and the tray 106 can have a third height D3, where the second and third heights, D2 and D3, are both less than the first height D2. The third height D3 does not include the height of the hollow base 128, but is just a height of the lid 102, for instance, as seen in FIG. 2 without the optional hollow base 128.

The lid 102 includes a top 110 having the opening 108 therein that can have a same or similar shape to that of the lid 102 generally. A transparent elastic film (not visible in FIG. 4) can be stretched across the opening 108 and can be coupled to a bottom of the top 110 via, in some embodiments, a frame 146 as seen in FIGS. 6 and 7. The frame 146 can couple to a frame channel 140 in the bottom of the top 110. An outer edge of the frame channel 140 can be formed by the sides 112 and an inner edge of the frame channel 140 can be formed by a flange 144 extending down form the top 110. This frame channel 140 may include one or more protrusions, spikes, nodules, or other extensions 142/152 that help hold the perimeter of the transparent elastic film in place against the frame 146 (and to hold the film taught across the opening 108). The frame 146 shown in FIG. 7 shows two examples of such protrusions 142 and 152, though either, both, or some other structure could be used for this same holding purpose. The lower lip 114 includes a retaining channel 138 in a bottom thereof shaped to accept an upper circumferential lip 116 of a stackable insert 104 or an upper circumferential lip 124 of the tray 106. In other words, the upper circumferential lip 124 of the tray 106 or the upper circumferential lip 116 of the stackable insert 104 can selectively slot into the retaining channel 138.

It should be noted that although this disclosure discusses and shows a transparent elastic film, in other embodiments, a fixed or rigid material could be used and it can be transparent, opaque, or semi-transparent.

FIG. 8 shows an embodiment of a stackable insert 104. This insert 104 includes an upper circumferential lip 116 and a lower lip 118, each of which are wider than the sides 112 of the insert 104. The upper circumferential lip 116 has a greater width in order to fit more into and be retained more securely by the retaining channel 138 in the lid 102 or in the retaining channel 136 of another insert 104. The lower lip 118 is shaped to accommodate such a retaining channel 136 in a bottom of the lower lip 118 (best seen in FIG. 9). Each insert 104 can be optionally formed with a thermally insulating tab 130 extending horizontally from the insert 104 to assist with removal of the insert 104 from other components of the system 100. A bottom 134 of the floor 122 can be seen in FIG. 9.

Figure 10A:
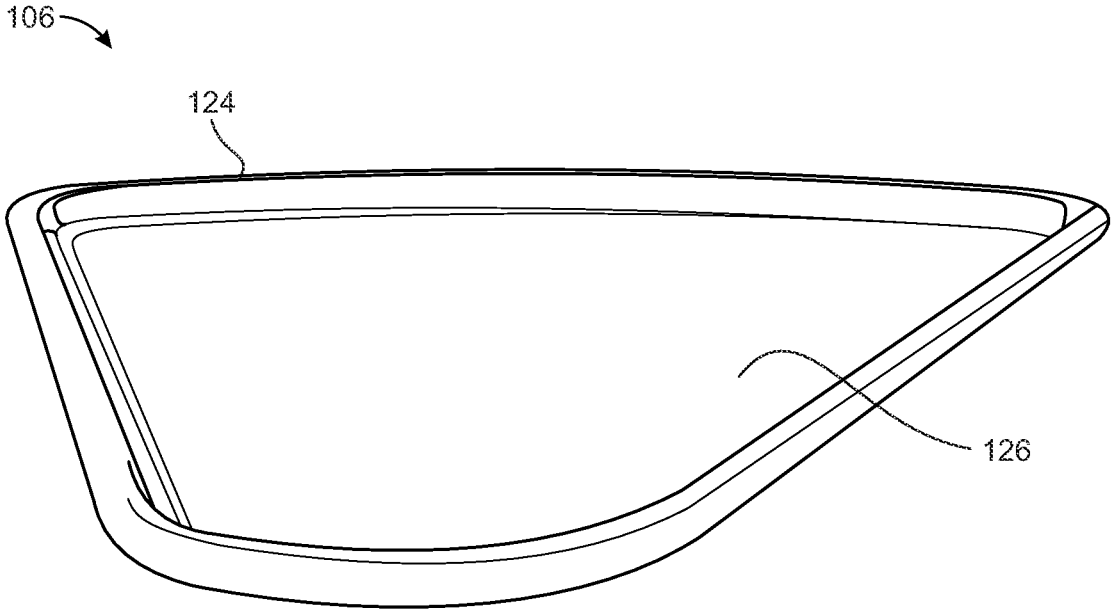
FIG. 10A shows an isometric view of the thermally conductive tray.
Figure 10B:
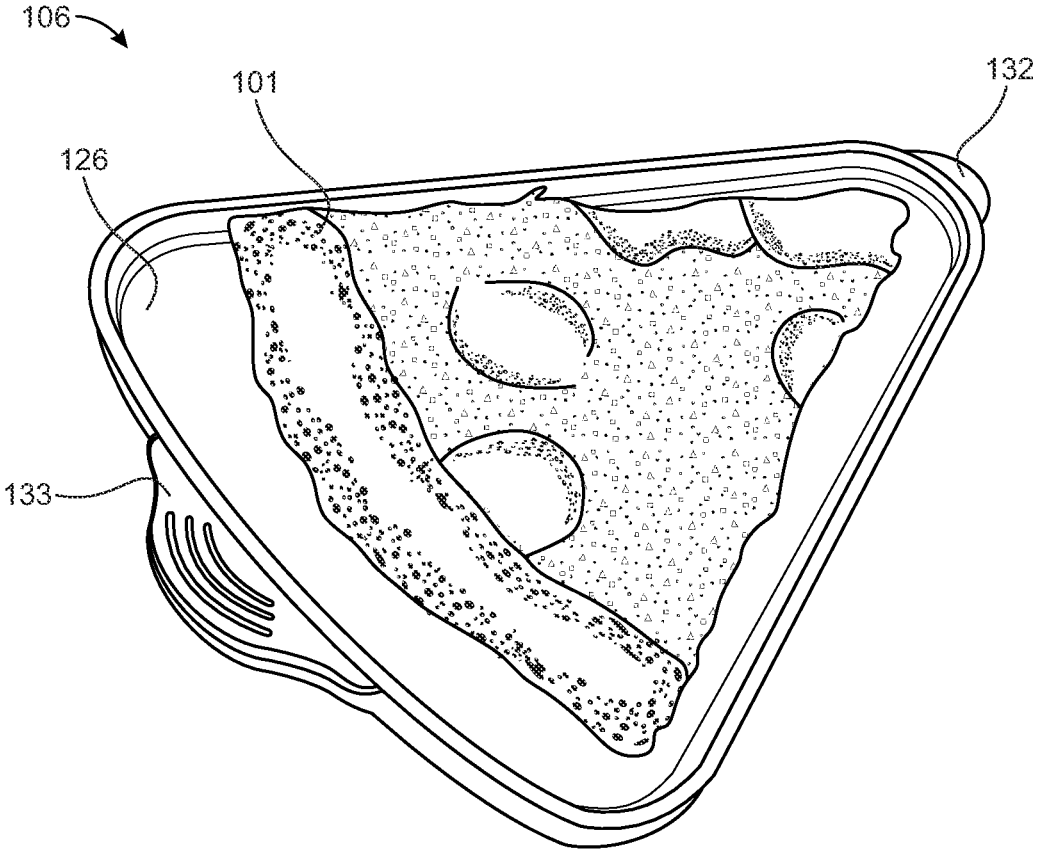
FIG. 10B shows an isometric view of the thermally conductive tray with a pizza slice thereon.

FIG. 10A shows an empty tray 106 and FIG. 10B shows the same tray 106 with a pizza slice 101 thereon. The tray 106 includes a floor 126 that sits between 1 mm and 2 cm below a top edge of the upper circumferential lip 124. The upper circumferential lip 124 is shaped to be received in the retaining channel 138 in the lid 102 or the retaining channel 136 in the stackable insert 104. The embodiment shown in FIG. 10A does not include tabs, while the one in FIG. 10B shows a tab 132 on a front of the tray and a tab 133 on a rear of the tray 106. These tabs 132 and 133 can be formed from a thermally insulating material such as silicone and can be overmolded onto a portion of the thermally conductive tray 106, such as a metal tab extending from the upper circumferential lip 124 or crimped into the upper circumferential lip 124 in the thermally conductive tray 106 as better seen in FIG. 11B. However, the tabs 132 and 133 can also extend directly from the upper circumferential lip 124 or include internal bracing to prevent flexing of the tabs 132 and 133.

Figure 11A:
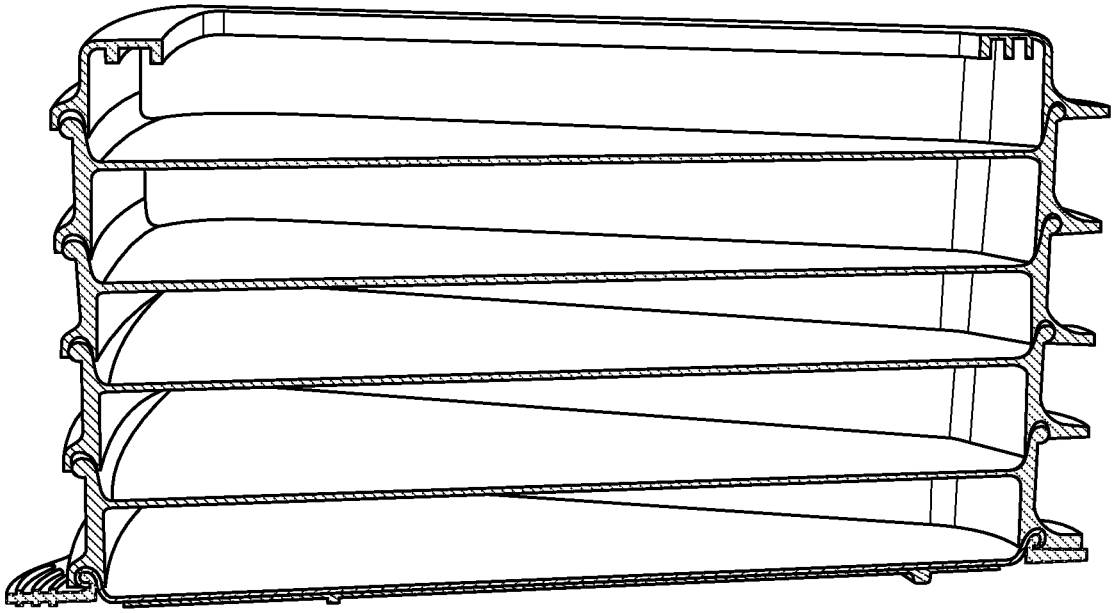
FIG. 11A illustrates a cross sectional view of a stackable triangular food container system with four stackable inserts, a lid, a thermally conductive tray, and tabs on the front and back of the thermally conductive tray.

FIG. 11A illustrates a cross sectional view of a stackable triangular food container system with four stackable inserts and thermally insulating tabs on the front and back of the thermally conductive tray.

Figure 11B:
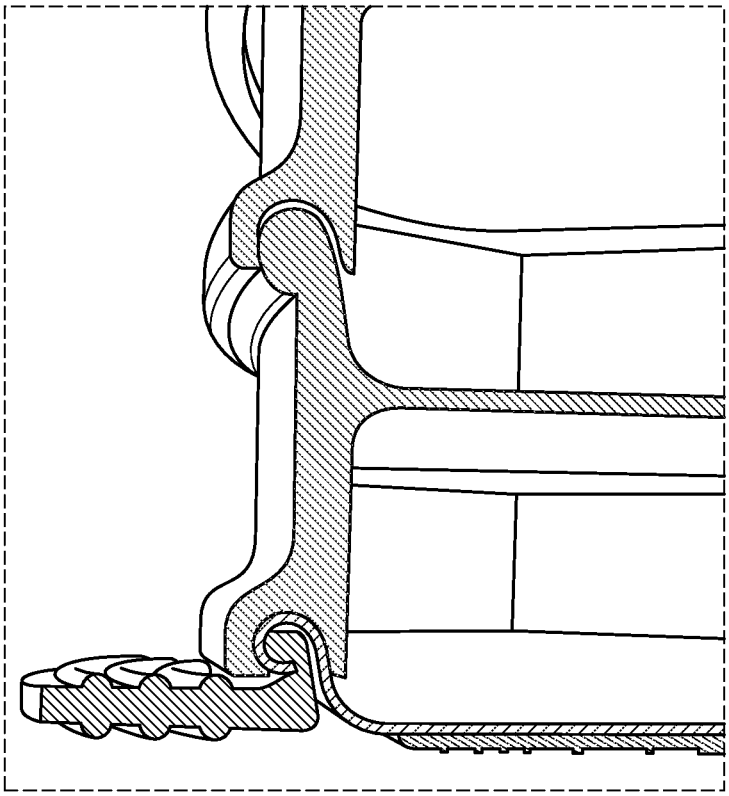
FIG. 11B illustrates a close up of a cross sectional view of the interlocking of the upper circumferential lip of the thermally conductive tray and the lower channel of a bottommost of the one or more stackable inserts as well as crimping of a tab into the thermally conductive tray.

FIG. 11B illustrates a close up of a cross sectional view of the interlocking of the upper circumferential lip of the thermally conducting tray and the lower channel of a bottommost of the one or more stackable inserts as well as crimping of a thermally insulating tab into the thermally conductive tray. This view also shows another stackable insert above the bottommost of the one or more stackable inserts, and an upper lip of the bottommost stackable insert selectively slotted into a retaining channel in a bottom circumferential lip of the another stackable insert.

FIG. 12 illustrates a cross sectional view of a stackable triangular food container system with a single stackable insert between a lid and a thermally conductive tray. The tray includes two tabs extending horizontally and outward from a center of the tray, and each tab is crimped to an upper lip of the tray. This configuration provides an upper (first) storage volume formed by the lid and the stackable insert, and a lower (second) storage volumed formed by the stackable insert and the thermally conductive tray.

FIG. 13 illustrates stretching of the transparent elastic film used to minimize air volume within the container and allow for various sizes of food (namely height) to be stored therein. As seen, sometimes a food item may be taller than the storage volume formed by the lid and the stackable insert or tray below, and in such cases, the elasticity of the transparent elastic polymer film stretches to allow such food items to be stored despite the fixed sidewall height. In traditional storage containers this may lead to the lid being unable to close, however in this disclosure use of the transparent elastic film allows the volume within the topmost storage container to adjust based on the size (e.g., height) of the food stored therein. For instance, in FIG. 13 one can see that the slice of pizza is taller than a top of the lid, but due to the elasticity of the transparent elastic film, the film is able to stretch and accommodate the pizza slice. Along these same lines, stretching of the transparent elastic film means that the volume of air within the topmost storage volume increases to match a size of the food. In this way, excess air is minimized and hence excess oxidation, which enhances preservation of food.

FIG. 14 illustrates a method of using a stackable triangular food container system. The method 1400 can include providing a triangular-shaped container comprising: a lid with transparent viewing window and a thermally conducting tray with an upper circumferential lip that selectively slots into a circumferential receiving space in a bottom of the lid (or a stackable insert) to form a nearly-air-tight seal between the lid and the thermally conducting tray (or stackable insert) (Block 1402). The method 1400 can also include placing a triangular-shaped food item into the triangular-shaped container and refrigerating the triangular-shaped container (Block 1404). Alternatively, the container can be placed in a freezer, lunchbox, cooler, or other insulated transportation container. The method can also include pre-heating the thermally conducting tray in a heating machine such as, but not limited to, a microwave or oven (Block 1406). The method 1400 can also include removing the thermally conducting tray from the heating machine and placing the triangular-shaped food item on the now hot thermally conducting tray (Block 1408) and returning the thermally conducting tray to the heating machine with the triangular-shaped food item arranged thereon (Block 1410). Alternatively, one can place the triangular-shaped food item on the pre-heated tray without removing the tray from the heating machine. The tray with food can be left in the heating machine for a sufficient time to allow a surface of the food item in contact with the tray to undergo a Maillard effect visible to the human eye (Block 1410). In other words, the tray effects a Maillard transformation. Optionally, the food item can be left on the tray after the heating machine is turned off or after the tray has been removed from the heating machine, and in this way, stored thermal energy in the tray can pass through conduction into a bottom surface of the food item thereby continuing to crisp the bottom of the food item even as the top, sides, and interior of the food item begin to cool. The lid can also be reattached to the metal alloy tray before the metal alloy tray and the triangular food item are returned to the microwave.

Although this disclosure often discusses a triangular or three-sided container system, in other embodiments, rectangular or square container systems can also be used along with similarly shaped food items such as a square pizza slice. In other words, the container system can be three- or four-sided.

The terms and expressions employed herein are used as terms and expressions of description and not of limitation, and there is no intention, in the use of such terms and expressions, of excluding any equivalents of the features shown and described or portions thereof. Each of the various elements disclosed herein may be achieved in a variety of manners. This disclosure should be understood to encompass each such variation, be it a variation of an embodiment of any apparatus, embodiment, a method or process embodiment, or even merely a variation of any element of these. Particularly, it should be understood that the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled.

As but one example, it should be understood that all action may be expressed as a means for taking that action or as an element which causes that action. Similarly, each physical element disclosed should be understood to encompass a disclosure of the action which that physical element facilitates. Regarding this last aspect, by way of example only, the disclosure of a "protrusion" should be understood to encompass disclosure of the act of "protruding"—whether explicitly discussed or not—and, conversely, were there only disclosure of the act of "protruding", such a disclosure should be understood to encompass disclosure of a "protrusion". Such changes and alternative terms are to be understood to be explicitly included in the description.

As used herein, the recitation of "at least one of A, B and C" is intended to mean "either A, B, C or any combination of A, B and C." The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

The invention claimed is:

1. A stackable triangular food container system, the stackable triangular food container system comprising:

a triangular lid having three polymer sides and a transparent elastic polymer film stretched across an opening in a top of the triangular lid to provide visibility into the stackable triangular food container system;

a first triangular stackable insert directly coupled to the triangular lid by way of a lip on the first triangular stackable insert engaging a channel on the triangular lid and directly coupled to a triangular thermally conductive tray by way of a lip on the triangular thermally conductive tray engaging a lip on the first triangular stackable insert, the first stackable insert having a floor arranged between sides of the first triangular stackable insert; and the triangular thermally conductive tray configured to be pre-heated without a food item and then heated in an oven or microwave with the food item resting thereupon to effect Maillard transformation of a bottom surface of the food item when reheated upon the triangular thermally conductive tray.

2. The stackable triangular food container system of claim 1, wherein the food item is a pizza slice.

3. The stackable triangular food container system of claim 1, further comprising a second triangular stackable insert directly coupled to the first triangular stackable insert and directly coupled to the triangular thermally conductive tray.

4. The stackable triangular food container system of claim 1, wherein the triangular thermally conductive tray is a metal alloy.

5. The stackable triangular food container system of claim 4, wherein the metal alloy is aluminized steel.

6. The stackable triangular food container system of claim 4, wherein the triangular thermally conductive tray is silicone coated.

7. The stackable triangular food container system of claim 1, wherein a triangular frame is coupled to the triangular lid, with a perimeter of the transparent elastic polymer film held therebetween, thereby holding and stretching taught the transparent elastic polymer film across the opening.

8. The stackable triangular food container system of claim 7, wherein the transparent elastic polymer film is configured to make contact with, and to stretch when in contact with, the food item resting on the first triangular stackable insert or on the triangular thermally conductive tray.

9. The stackable triangular food container system of claim 1, wherein the triangular lid has a first height, the first triangular stackable insert has a second height, and the triangular thermally conductive tray has a third height, and wherein the second height is greater than the first height.

10. The stackable triangular food container system of claim 9, wherein the second height is greater than the third height.

11. The stackable triangular food container system of claim 1, wherein the triangular thermally conductive tray further comprises a thermally insulating tab extending substantially horizontally from a side of the triangular thermally conductive tray.

12. A stackable triangular food container system, the stackable triangular food container system comprising:

a triangular lid having three polymer sides and a transparent elastic polymer film stretched across an opening in a top of the triangular lid;

a first triangular stackable insert directly coupled to the triangular lid and directly coupled to a triangular thermally conductive tray and having a floor arranged between sides of the first triangular stackable insert; and a second triangular stackable insert directly coupled to the first triangular stackable insert and directly coupled to the triangular thermally conductive tray, wherein the second triangular stackable insert is directly coupled to the first triangular stackable insert by way of a lip on the second triangular stackable insert engaging a channel on the first triangular stackable insert;

the triangular thermally conductive tray configured to be pre-heated without a food item and then heated in an oven or microwave with the food item resting thereupon to effect Maillard transformation of a bottom surface of the food item when reheated upon the triangular thermally conductive tray.

13. The stackable triangular food container system of claim 12, wherein a triangular frame is coupled to the triangular lid, with a perimeter of the transparent elastic polymer film held therebetween, thereby holding and stretching taught the transparent elastic polymer film across the opening.

14. The stackable triangular food container system of claim 13, wherein the transparent elastic polymer film is configured to make contact with, and to stretch when in contact with, the food item resting on the first triangular stackable insert or on the triangular thermally conductive tray.

15. The stackable triangular food container system of claim 12, wherein the triangular lid has a first height, the first triangular stackable insert has a second height, and the triangular thermally conductive tray has a third height, and wherein the second height is greater than the first height.

16. The stackable triangular food container system of claim 15, wherein the second height is greater than the third height.

17. The stackable triangular food container system of claim 12, wherein the triangular thermally conductive tray further comprises a thermally insulating tab extending substantially horizontally from a side of the triangular thermally conductive tray.

* * * * *